US006350174B1

(12) United States Patent
Halford et al.

(10) Patent No.: US 6,350,174 B1
(45) Date of Patent: Feb. 26, 2002

(54) ROLL-UP HALFPIPE FOR MINIATURE TOY SKATEBOARD

(75) Inventors: Wayne Halford, Hermosa Beach, CA (US); Eric SodKar Fai, Hong Kong (CN); Steven Moran, Long Beach, CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/632,119

(22) Filed: Aug. 3, 2000

(51) Int. Cl.[7] ..... A63H 18/00

(52) U.S. Cl. ..... 446/444; 446/478; 472/89

(58) Field of Search ..... 446/444, 445, 446/429, 430, 476, 478, 487, 489; 472/89, 91; 482/66, 68; 104/69

(56) References Cited

U.S. PATENT DOCUMENTS

| | | | | | |
|---|---|---|---|---|---|
| 318,025 | A | | 5/1885 | Pusey | |
| 999,466 | A | * | 8/1911 | Richter | 446/108 |
| 1,544,555 | A | * | 7/1925 | Chase | 446/444 X |
| 2,070,887 | A | * | 2/1937 | Dunn, Jr. et al. | 446/476 X |
| 2,144,751 | A | | 1/1939 | Brown | |
| 2,927,397 | A | | 3/1960 | Wilson | |
| 2,992,598 | A | * | 7/1961 | Einfalt | 446/444 X |
| 3,018,583 | A | | 1/1962 | Novotney | |
| 3,195,265 | A | | 7/1965 | Marquez et al. | |
| 3,660,926 | A | | 5/1972 | Lerner et al. | |
| 4,129,916 | A | | 12/1978 | Schlesinger et al. | |
| D256,488 | S | | 8/1980 | Firestone | |
| D258,459 | S | | 3/1981 | Firestone | |
| D258,460 | S | | 3/1981 | Firestone | |
| 4,285,514 | A | | 8/1981 | Romero | |
| 4,394,961 | A | * | 7/1983 | Muller | 446/444 X |
| 4,516,953 | A | * | 5/1985 | Hippely et al. | 446/444 |
| 5,232,423 | A | | 8/1993 | Hajduczek | |
| 5,299,969 | A | * | 4/1994 | Zaruba | 446/444 X |
| 5,524,310 | A | | 6/1996 | Farnen | |
| 5,599,235 | A | | 2/1997 | Lynberg | |
| 5,749,615 | A | | 5/1998 | Itson | |
| 6,042,480 | A | * | 3/2000 | Labelson | 472/89 |

* cited by examiner

*Primary Examiner*—D. Neal Muir
(74) *Attorney, Agent, or Firm*—Roy A. Ekstrand

(57) ABSTRACT

A miniature roll-up halfpipe for use with fingerboards or miniature skateboards includes a pair of sideframes configurable in either a collapsed compact configuration or an extended open configuration. A pair of platforms join the end portions of the sideframes to form a generally rectangular structure having a pair of upwardly open curved edges. A flexible resilient sheet is received upon the supporting frame to form a curved surface of the type frequently used by skateboarder's or the like. In the closed configuration, the flexible sheet is rolled into a cylindrical shape and encloses the collapsed siderails and platform elements. A pair of generally cylindrical endcaps are received upon the opposed ends of the rolled sheet to provide closure and secure attachment thereof.

6 Claims, 3 Drawing Sheets

FIG. 1
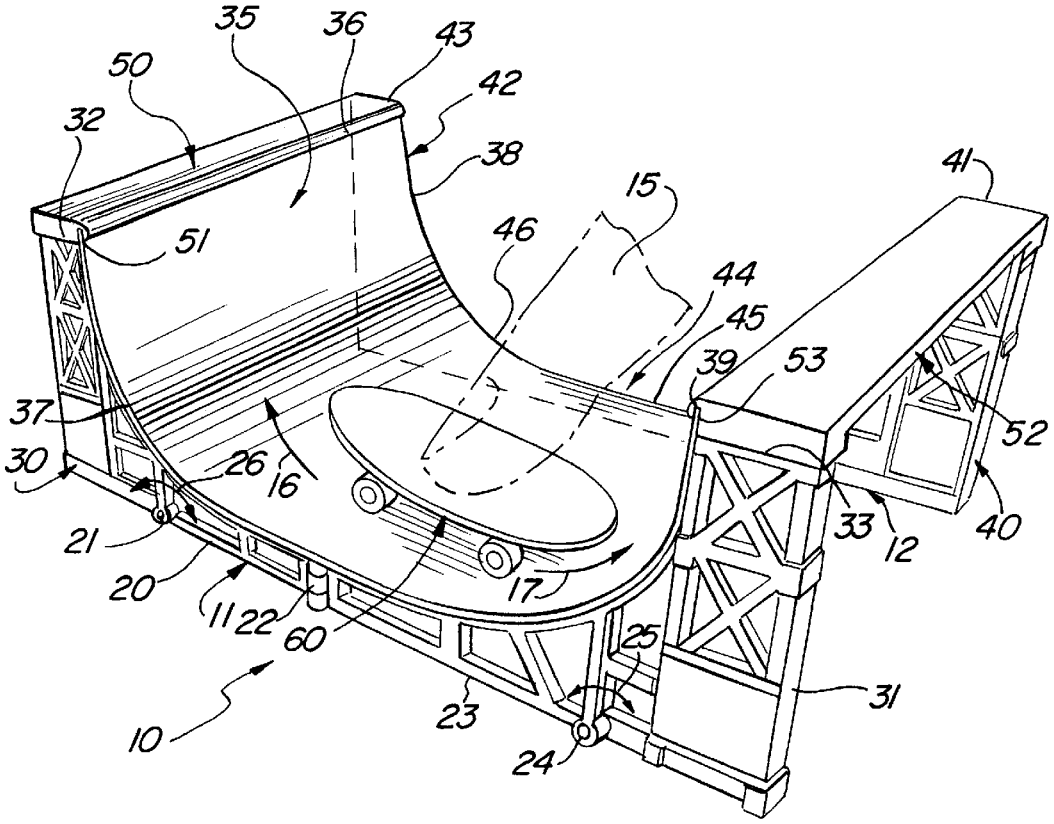
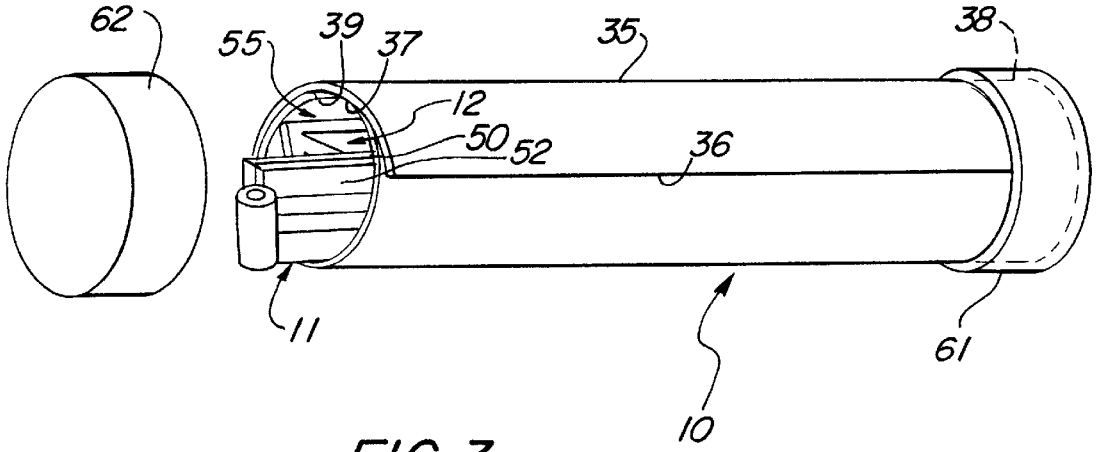
FIG. 3

ROLL-UP HALFPIPE FOR MINIATURE TOY SKATEBOARD

FIELD OF THE INVENTION

This invention relates generally to toy skateboards and particularly to accessory stunt performing apparatus usable in conjunction therewith.

BACKGROUND OF THE INVENTION

In resent years, a toy trend has emerged which is directed toward wide spread use of miniaturized toys and toy items. In accordance with this trend, practitioner's have provided miniature cars, trucks, motorcycles, scooter's, and sport apparatus such as skateboards or the like. Such miniatures are often highly detailed and precise in their replication of the corresponding full size device. Consumer's have found such highly detailed and precise miniature toys to be attractive and popular for both use as play items and for accumulating as collectibles.

One of the more unusual miniature toy items to emerge in great popularity in resent years is found in miniature versions of skateboards. Such miniature version skateboards are generally referred to as "fingerboards" due to the manner in which the child user plays with the miniature skateboard. In a typical play pattern, the user places a single finger or pair of fingers upon the upper surface of the fingerboard and rolls the fingerboard across various surfaces. In addition, the user's become extremely adapt at exercising various maneuvers such as jumps or spins through a manipulation of the pressure upon and force exerted against the upper surface of the fingerboard. Notsurprisingly, serious fingerboard enthusiast endeavor to mimic conventional skateboard sport and play patterns such as competitive events, stunts, tricks or the like. To perform such stunts, tricks or competitive events, practitioner's attempt to utilize apparatus which closely resembles or mimics the standard apparatus used by skateboarder's. Such stand skateboard trick and competition apparatus has been provided in a variety of shapes and configurations. For example, U.S. Pat. Des. No. 256,488 issued to Firestone sets forth a SKATEBOARD RAMP having a generally curved upwardly facing semi-cylindrical frame structure supported by a plurality of support legs. A smooth curved cylindrical surface is supported upon the interior of the supporting frame.

U.S. Pat. Des. No. 258,459 issued to Firestone sets forth a SKATEBOARD RAMP BOWL having a frame structure supporting an upwardly open curved recess having curved closed ends formed therein. An interior surface supported by the structure forms an upwardly open continuously curved surface suitable for use by skateboarder's.

U.S. Pat. Des. No. 258,460 issued to Firestone sets forth a TRAILABLE SKATEBOARD RAMP having a curved skateboard ramp structure joined to and supportable by a trailer. The support structure includes downwardly extending support legs which allow fixation of the ramp structure without removal from the supporting trailer.

U.S. Pat. No. 4,129,916 issued to Schlesinger et al sets forth an ADJUSTABLE SKATEBOARD RAMP having a support frame defining a horizontal portion and a vertical portion each of which includes extending outer members joined to form an approximate right angle. A curved ramp surface is secured to the extending members and defines a curvature in accordance with the relative extensions of the horizontal and vertical supports.

U.S. Pat. No. 4,285,514 issued to Romero sets forth a RAMP DEVICE FOR PRACTICING WHEELED SPORTS having a pair of generally planar ramp members commonly joined at a hinged junction and pivotable relative to each other to form a peak or two-sided ramp. Each of the hinged ramp portions is supported by a collapsible support structure.

U.S. Pat. No. 5,524,310 issued to Farnen sets forth a MODULAR HALFPIPE SKATEBOARD RAMP AND METHOD OF CONSTRUCTING having a collapsible ramp structure supporting a curved ramp surface formed in a modular manner to facilitate assembly of more complex ramp combinations.

U.S. Pat. No. 5,599,235 issued to Lynberg sets forth a COLLAPSIBLE SKATE RAMP utilized in providing lift for in-line skater's, skateboarder's and cyclist's. The lateral sections of the ramp are attached in a manner which facilitates easy assembly of the ramp structure.

U.S. Pat. No. 5,749,615 issued to Itson sets forth a CYCLING AND SKATING RAMP TRAILER having a pair of trailers each supporting a collapsible ramp structure and each towable by a powered vehicle.

U.S. Pat. No. 5,232,423 issued to Hajduczek sets forth an EXERCISE APPARATUS having a concaved track forming a circular segment and having a predetermined radius. A platform is movable upon the track and is configured to allow the primary axis of a user's body standing upon the movable platform to remain in a generally upright position as the user slides back and forth upon the track.

In a second area of the prior art generally related to the collapsible aspect of the present invention, practitioner's in the art have provided a variety of toys configurable between a container package and a useful toy. For example, U.S. Pat. No. 2,927,397 issued to Wilson sets forth a KNOCK DOWN ANIMAL TOY having a generally cylindrical housing and a pair of circular end caps fittable thereon. A plurality of animal appendages and body components such as head, legs and a tail are alternately securable to the cylindrical body to form a toy animal or stored within the cylindrical body.

U.S. Pat. No. 3,018,583 issued to Novoteny sets forth a TOY used in combination with a conventional beverage can. A beverage can defining a generally cylindrical shape is used to support a pair of circular end caps on each end thereof. The end caps define various apertures to which a plurality of body components and appendages such as the head, legs and tail of a horse may be secured to form a figure.

U.S. Pat. No. 2,144,751 issued to Brown sets forth a FIGURE TOY CONTAINER having a generally cylindrical body supported by a plurality of removably attached appendages. In one configuration the appendages are secured to the cylindrical body to provide a fanciful human-like figure while in a storage configuration certain appendage elements are removed from attachment to the cylindrical body and stored therein. In an alternate embodiment, a similar figure forming a four-legged animal is shown.

U.S. Pat. No. 3,660,926 issued to Lerner et al and U.S. Pat. No. 3,195,265 issued to Marquez et al set forth examples of toys formed from cylindrical elements.

U.S. Pat. No. 318,025 issued to Pusey sets forth an ARTIFICIAL COASTING OR SLEDDING COARSE having a pair of support towers on each end of a curved ramp operable to allow user's to slide across the ramp from tower to tower.

While the foregoing described prior art devices have to some extent improved the art and in some instances enjoyed commercial success, there remains nonetheless a continuing need in the art for ever more improved interesting and amusing toy apparatus.

SUMMARY OF THE INVENTION

Accordingly, it is a general object of the present invention to provide an improved toy apparatus. It is more particular object of the present invention to provide an improved toy apparatus suitable for use in combination with a fingerboard or other similar apparatus such as a skating doll or the like to perform various simulated stunts and play activities.

In accordance with the present invention there is provided a roll-up halfpipe for miniature toy skateboard, the halfpipe comprising; a pair of sideframes each alternatively configurable in an open configuration and a collapsed configuration; a pair of platforms each having opposed ends and each being attachable to the side frames in the open configuration to support the side frames in a generally parallel relationship; a planar sheet having opposed end edges and side edges, the planar sheet being formed of a resilient material and constructed to be alternatively rolled into a generally cylindrical closed configuration and an open configuration defining an upwardly open cylindrical ramp; and a pair of endcaps receivable upon the planar sheet in the generally cylindrical closed configuration, the pair of sideframes, when in the open configuration, being constructed to cooperate with the pair of platforms to support the planar sheet in the cylindrical ramp configuration and the pair of platforms and the pair of sideframes, when in the collapsed configuration, being enclosed within the planar sheet in the closed configuration and the endcaps.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 sets forth a perspective view of a roll-up halfpipe for miniature toy skateboard constructed in accordance with the present invention;

FIG. 3 sets forth a partial assembly view of the present invention roll-up halfpipe in its carrying or storage configuration;

DESCRIPTION OF THE PREFERRED EMBODIMENT

Figure 2:
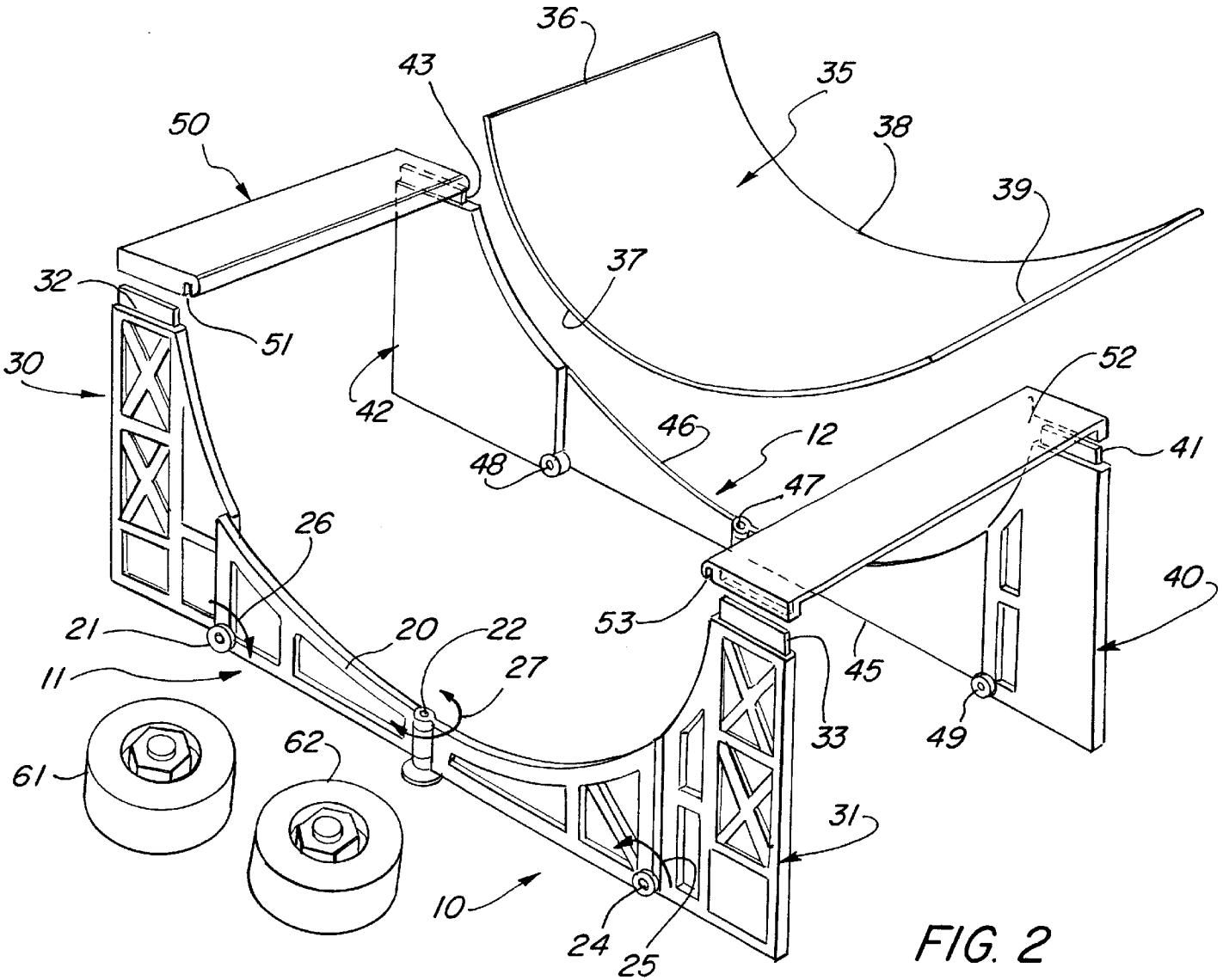
FIG. 2 sets forth a perspective assembly of the roll-up halfpipe of FIG. 1.

FIG. 1 sets forth a perspective view of a miniature halfpipe constructed in accordance with the present invention and generally referenced by numeral 10. Halfpipe 10 is fabricated of an appropriate miniature size to accommodate a fingerboard 60 constructed to replicate a conventional skateboard. Halfpipe 10 includes a pair of sideframes 11 and 12 positioned in a generally parallel arrangement. Sideframes 11 and 12 are substantially identical in fabrication and in accordance with the present invention are capable of being collapsed or folded to facilitate the compact storage configuration set forth below in FIG. 3.

More specifically, sideframe 11 includes a pair of siderails 20 and 23 pivotally joined at a hinge 22. Sideframe 11 further includes a pair of vertically extending endstands 30 and 31 each having upper ends 32 and 33 respectively. Endstand 30 is pivotally secured to the outer end of siderail 20 by a hinge 21 and is pivotable in the directions indicated by arrows 26. Similarly, endstand 31 is pivotally secured to the outer end of siderail 23 by a hinge 24 and is pivotable in the directions indicated by arrows 25.

As is better seen in FIG. 2, sideframe 12 which is substantially identical to sideframe 11 includes a pair of siderails 45 and 46 joined at a hinge 47. By way of further correspondence, sideframe 12 includes a pair of endstands 40 and 42 pivotally secured to siderails 45 and 46 respectively by hinges 49 and 48. Endstands 40 and 42 defines respective upper ends 41 and 43 (better seen in FIG. 2).

Halfpipe 10 further includes a pair of generally planar platforms 50 and 52 defining respective grooves 51 and 53. By conventional attachment means (seen in FIG. 2) platform 50 is secured to ends 32 and 43 of endstands 30 and 42 while platform 52 is secured to ends 33 and 41 of endstand 31 and 40.

Halfpipe 10 further includes a flexible sheet 35 preferably formed of a slightly flexible resilient material such as thin plastic or the like. The essential characteristic of sheet 35 is the possession of sufficient strength and resilience to maintain a suitable ramp surface upon halfpipe 10 while being nonetheless sufficiently flexible to be curled or rolled into the closed configuration shown in FIG. 3. Sheet 35 defines a pair of edges 36 and 39 at opposite ends thereof and a pair of side edges 37 and 38. Edges 36 and 39 are received within grooves 51 and 53 of platforms 50 and 52 respectively.

Thus, in the assembled configuration shown in FIG. 1, halfpipe 10 forms a stand alone generally rigid structure upon which the user is able to roll fingerboard 60 back and forth in the directions indicated by arrows 16 and 17 as the user places a finger 15 upon the upper surface of the fingerboard. The user then manipulates fingerboard 16 in accordance with typical skateboard maneuvers and stunts.

FIG. 2 sets forth a perspective assembly view of halfpipe 10 together with endcaps 61 and 62. As described above, halfpipe 10 includes a pair of substantially identical sideframes 11 and 12 joined by a pair of platforms 50 and 52 in a snap-fit attachment. Sideframe 11 includes a pair of siderails 20 and 23 joined by a hinge 22 together with a pair of endstands 30 and 31 joined to siderails 20 and 23 by hinges 21 and 24 respectively. Endstands 30 and 31 defines respective upper ends 32 and 33. Ends 32 and 33 are configured to snap-fit into sockets formed in platforms 50 and 52.

Similarly, sideframe 12 includes a pair of siderails 45 and 46 joined by a hinge 47 together with a pair of endstands 40 and 42 pivotally secured to siderails 45 and 46 by hinges 49 and 48. Endstands 40 and 42 define upper ends 41 and 43 configured to snap-fit attach to platforms 52 and 50 respectively. Thus, the combination of sideframes 11 and 12 together with platforms 50 and 52 provides the supporting strength for halfpipe 10 in the open or extended configurations thereof shown in FIG. 2.

Halfpipe 10 further includes a resilient flexible sheet 35 preferably formed of a somewhat rigid material such as thin plastic or the like. Sheet 35 defines edges 36 and 39 at each end thereof together with side edges 37 and 38. The material thickness selected for sheet 35 is chosen to provide sufficient rigidity to span the space between sideframes 11 and 12 to facilitate the above described fingerboard play while concurrently being sufficiently flexible to be rolled into the closed configuration shown in FIG. 3. Endcaps 61 and 62 are utilized in combination with sheet 35 in its rolled configuration shown in FIG. 3 to provide closure of the rolled sheet structure. Sheet 35 is secured at edges 36 and 39 by grooves 51 and 53 formed in platforms 50 and 52. With edges 36 and 39 secured to platforms 50 and 52, the resilience and strength of sheet 35 causes sheet 35 to be pressed against the upper edges of side frames 11 and 12 which support edges 37 and 38 respectively of sheet 35.

Figure 4:
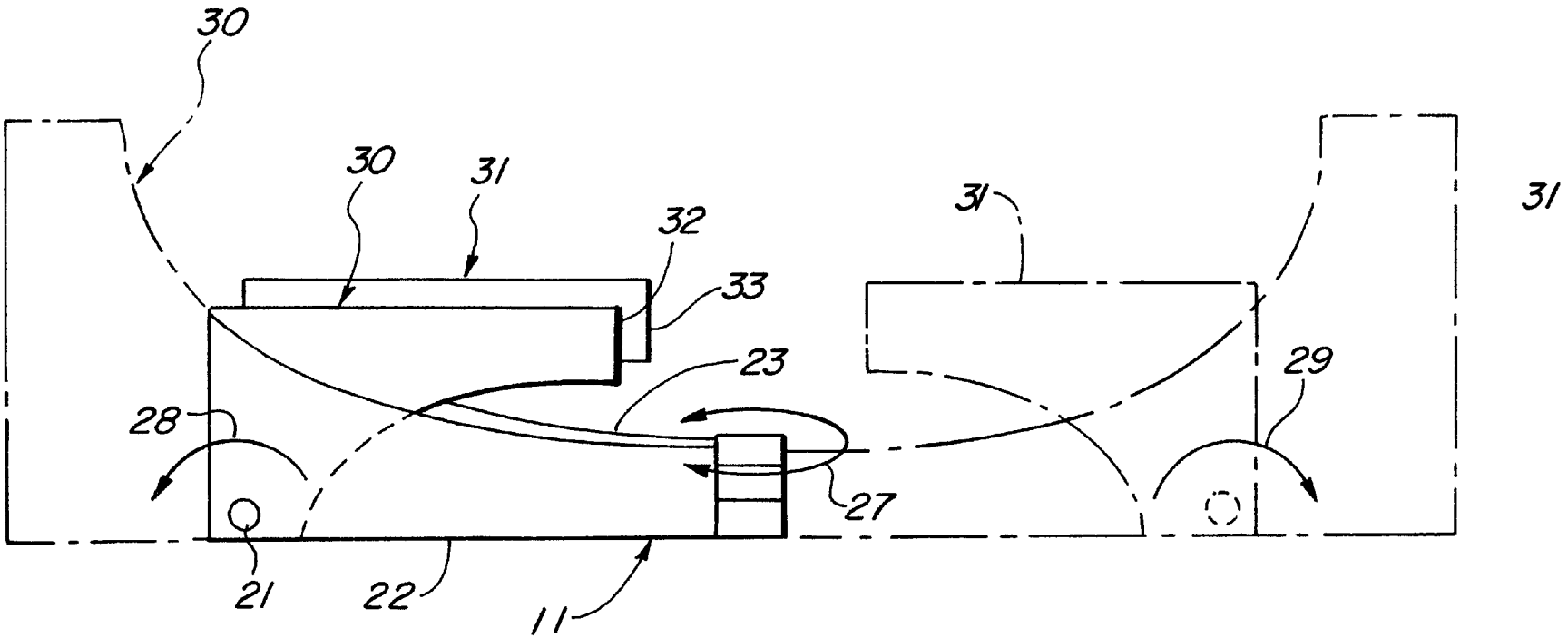
FIG. 4 sets forth a side elevation view of a collapsible lateral support member utilized in the present invention roll-up halfpipe in its folded position having its extended position shown in dashed-line.

In accordance with an important aspect of the present invention, halfpipe 10 may be disassembled and conveniently packed and carried in the manner shown in FIG. 3. The disassembly of halfpipe 10 is carried forward by removing the snap-fit attachments of platforms 50 and 52 upon sideframes 11 and 12. This releases sheet 35 and sideframes 11 and 12. Thereafter, sideframe 11 is collapsed by pivoting siderail 23 about hinge 22 to bring siderails 20 and 23 into a parallel side-by-side arrangement such as that shown in FIG. 4 in solid-line representation. Thereafter, endstands 30 and 31 are pivoted about hinges 21 and 24 respectively in the directions indicated by arrows 26 and 25 to configure sideframe 11 in its fully collapsed position as shown in FIG. 4 in solid-line representation. Sideframe 12 is similarly collapsed by pivoting siderails 45 and 46 about hinge 47 and pivoting endstands 40 and 42 about hinges 49 and 48.

At this point, the user simply rolls sheet 35 in the manner shown in FIG. 3 to form a cylindrical body and places one end thereof into either of endcaps 61 and 62. Sideframes 11 and 12 in their collapsed position together with platforms 50 and 52 may then be placed within the interior defines by sheet 35 in its rolled configuration (seen in FIG. 3). The final closure is accomplished by simply utilizing the remaining one of endcaps 61 or 62 to captivate the open end of rolled sheet 35 as is also better seen in FIG. 3.

FIG. 3 sets forth a perspective assembly view of halfpipe 10 in its closed configuration. As can be seen, sheet 35 having edges 36 and 39 as well as side edges 37 and 38 has been rolled into a generally cylindrical configuration after which endcap 61 is secured upon edge 38. In its rolled configuration, sheet 35 defines an interior cavity 55 within which the structural elements of halfpipe 10 such as sideframes 11 and 12 together with platforms 50 and 52 may be received. As a final step, endcap 62 is secured upon edge 37 and the end portion of rolled sheet 35 to complete closure of halfpipe 10. The resilience of sheet 35 produces a sufficient spring force urging sheet 35 against its rolled configuration to maintain a secure attachment of endcaps 61 and 62. In this manner, the present invention halfpipe may be conveniently carried or stored.

The assembly of halfpipe 10 into the open or operative configuration shown in FIG. 1 is carried forward in a generally reverse process to that described above. Thus, endcaps 61 and 62 are removed from sheet 35 and the structural components of halfpipe 10 such as sideframes 11 and 12 and platforms 50 and 52 are retrieved from the interior of sheet 35 and opened to their extended configurations shown in FIGS. 1 and 2. Thereafter, sheet 35 is positioned upon sideframes 11 and 12 and platforms 50 and 52 are snap-fitted to captivate sheet 35 in the manner shown in FIG. 1.

FIG. 4 sets forth a side elevation view of sideframe 11 illustrating its collapsed configuration in solid-line representation. Sideframe 11 is also shown in dashed-line configuration in its extended configuration. In the collapsed configuration shown in FIG. 4, sideframe 11 includes siderails 20 and 23 pivoted together at hinge 22 in the directions indicated by arrows 27. Further, endstands 30 and 31 having ends 32 and 33 are shown pivoted to their collapsed position.

Sideframe 11 is returned to its extended configuration by pivoting siderails 20 and 23 about hinge 22 to move siderail 23 to the dashed-line position shown. Sideframe 11 is fully extended by pivoting endstands 30 and 31 about hinges 21 and 24 in the directions indicated by arrows 28 and 29 to the fully extended positions shown in dashed-line representation.

It will be understood that the structure of sideframes 11 and 12 are substantially identical and thus the descriptions and figures set forth herein will be understood to apply equally well and be equally descriptive of the structure of sideframe 12. Thus, sideframes 11 and 12 are capable of configuration in a collapsed position suitable for insertion into sheet 35 in the manner shown in FIG. 3 or to an extended configuration suitable for use as supporting structure for sheet 35 in the manner shown in FIG. 1.

What has been shown is a novel roll-up halfpipe for use in combination with miniature toy skateboards or "fingerboards" which is collapsible to provide convenient storage and carrying in an extremely compact and interesting configuration. The apparatus is suitable for fabrication using conventional molded plastic elements and is relatively simple to assemble and disassemble by younger children.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A roll-up halfpipe for miniature toy skateboard, said halfpipe comprising:

a pair of sideframes each alternatively configurable in an open configuration and a collapsed configuration;

a pair of platforms each having opposed ends and each being attachable to said side frames in said open configuration to support said side frames in a generally parallel relationship;

a planar sheet having opposed end edges and side edges, said planar sheet being formed of a resilient material and constructed to be alternatively rolled into a generally cylindrical closed configuration and an open configuration defining an upwardly open cylindrical ramp; and a pair of endcaps receivable upon said planar sheet in said generally cylindrical closed configuration, said pair of sideframes, when in said open configuration, being constructed to cooperate with said pair of platforms to support said planar sheet in said cylindrical ramp configuration and said pair of platforms and said pair of sideframes, when in said collapsed configuration, being enclosed within said planar sheet in said closed configuration and said endcaps.

2. The halfpipe set forth in claim 1 wherein each of said sideframes include:

a pair of siderails each having a curved upper edge; and a center hinge pivotably joining said siderails, whereby said pair of siderails are pivotable between a side-by-side collapsed configuration and an in-line open configuration.

3. The halfpipe set forth in claim 2 wherein each of said sideframes include:

a pair of endstrands positioned opposite said center hinge; and a pair of hinges pivotably joining said endstrands to said siderails, said pair of enstrands being pivotable between an open configuration in which said endstrands rise vertically and closed configuration in which said endstrands are configured along side of said siderails.

4. The halfpipe set forth in claim 3 wherein each of said endstrands defines an upper end constructed to support one of said opposed ends of said platforms.

5. The halfpipe set forth in claim 4 wherein each of said platforms defines a groove for receiving one of said opposed edges of said planar sheet.

6. A roll-up halfpipe for use in combination with a fingerboard, said roll-up halfpipe comprising:

a frame formed of collapsible sideframes and transverse platforms joining said sideframes to form a ramp support;

a resilient planar sheet supported upon said frame to form a fingerboard ramp; and a pair of endcaps;

said collapsible sideframes being collapsible to a closed configuration and said planar sheet being constructed to be rollable into a hollow cylinder for receiving said platforms and said sideframes in said closed configuration and said endcaps being constructed to close said hollow cylinder to captivate said sideframes and said platforms.

* * * * *